US006405401B1

(12) United States Patent
Hellerud et al.

(10) Patent No.: US 6,405,401 B1
(45) Date of Patent: Jun. 18, 2002

(54) TOOTHBRUSH HAVING A BRISTLE PATTERN WHICH PROVIDES ENHANCED CLEANING

(75) Inventors: Geir Hellerud; Nils Terje Vestheim, both of Olso (NO); Sapaporn Kangvanvegchkul, Willington (NZ); Thomas Mintel, Rahway, NJ (US)

(73) Assignees: Colgate-Palmolive Company, New York, NY (US); Jordan Haavard Martinsens, Oslo (NO)

( * ) Notice: Subject to any disclaimer, the term of this patent is extended or adjusted under 35 U.S.C. 154(b) by 0 days.

(21) Appl. No.: 09/681,974

(22) Filed: Jul. 2, 2001

(51) Int. Cl.[7] ..... A46B 9/04
(52) U.S. Cl. ..... 15/167.1; 15/207.2; 15/DIG. 5
(58) Field of Search ..... 15/187.1, 207.2, 15/DIG. 5; D4/104, 132

(56) References Cited

U.S. PATENT DOCUMENTS 1,360,615 A * 11/1920 Bolard
2,978,724 A * 4/1961 Gracian
4,081,876 A * 4/1978 Pugh
D364,740 S * 12/1995 Loew
D372,584 S * 8/1996 Yost et al.
D406,464 S * 3/1999 Yost et al.
6,041,468 A * 3/2000 Chen et al.
D424,808 S * 5/2000 Beals
D430,730 S * 9/2000 Klein
D434,563 S * 12/2000 Lim et al.
D436,733 S * 1/2001 Klein
6,272,714 B2 * 8/2001 Beals
6,308,367 B1 * 10/2001 Beals et al.

FOREIGN PATENT DOCUMENTS

WO WO 99/23910 * 5/1999

* cited by examiner

*Primary Examiner*—Terrence R. Till
(74) *Attorney, Agent, or Firm*—Henry S. Goldfine

(57) ABSTRACT

According to the practice of the present invention, a toothbrush with two distinct, flexible bristle groups, a more densely packed first bristle group adjacent the toe of the toothbrush and a less densely packed second bristle group further from the brush toe, each group containing at least one radius of curvature and the second grouping containing two subsets of bristle tufts, the first subset of bristle tufts angled toward the toe of the toothbrush and the other away therefrom, which combination of features provides enhanced conformity to the curvature of the teeth and enhanced cleaning thereof.

27 Claims, 2 Drawing Sheets

TOOTHBRUSH HAVING A BRISTLE PATTERN WHICH PROVIDES ENHANCED CLEANING

FIELD OF THE INVENTION

The present invention relates to toothbrushes, and more particularly, to toothbrushes having a particular combination of bristle tuft flexibility, density, angles and trim to provide enhanced conformity to the topography of the teeth for better cleaning thereof.

BACKGROUND OF THE INVENTION

The primary purpose of toothbrushes is to clean the teeth by removing plaque and debris from the tooth surfaces, including the curved outer tooth surfaces and the interproximal surfaces between the teeth, i.e. the topography of the teeth. To facilitate such cleaning, conventional toothbrushes comprise generally uniform length tufts of bristles, a flat bristle trim, each bristle having an end which is held captive in and fixed to a brush head, and an end which is free and which is used for brushing. Toothbrushes having such a generally flat bristle trim are limited in their ability to conform to the curved surfaces of each tooth or to penetrate into the interproximal areas between the teeth.

The desire of users to cause brushes having such generally flat bristle trims to conform to the curved teeth and to penetrate into and reach the interproximal tooth surfaces is expressed by the forceful application of the brush to adequately deform the bristles to the topography of the teeth. Such forceful application of the brush deleteriously leads to excessive wear and irritation of gums without adequate conformation of the brush about and between the teeth to provide the desired cleaning.

U.S. Pat. No. 5,742,972 discloses a toothbrush having a bristle trim containing at the toe region of the head, furthest from the handle, a ramping down subset of bristle tufts with the longest bristle tuft adjacent to the toe. Along the heel region of the head, closest to the handle, is a series of bristle rows wherein any transverse cross-section of which is concave in shape, i.e. the bristle tufts along each side of the brush being longer than those closer to the center of the brush. This combination of tufts is designed to provide enhanced interproximal and gingival margin cleaning by better conforming to the curved surfaces of and between the teeth. While this combination of tufts does provide better conformity to the topography of the dentiture than a conventional uniform length, flat trim toothbrush; it does not have the diversity of tufts and trim necessary to provide the enhanced cleaning desired.

Alternately, U.S. Pat. Nos. 5,335,389, 5,341,537, 5,446,940 and U.S. Pat. No. Des. 352,396 disclose various other toothbrushes containing a combination of longer and shorter bristle tufts and bristle bars, which are orthogonal and acutely angled to the face of the disclosed toothbrushes. As in the case of U.S. Pat. No. 5,742,972, these toothbrushes will better conform to the curved surfaces of the teeth than conventional flat trim toothbrushes; but, also as in the case of U.S. Pat. No. 5,742,972, they do not have the diversity of bristle tufts and trim to provide the enhanced cleaning desired.

PCT International Publication WO 99/23910 discloses a toothbrush with a greater diversity of tufts, i.e. five (5) different bristle tufts, including a first enlarged tuft located at the toe of the toothbrush with a cross-sectional area of about 0.0373 square inches (0.241 $cm^2$). This enlarged tuft is composed of uniform, flat trimmed, 0.440 inch (11.176 mm) long bristles which are densely packed and this enlarged tuft is angled forward to extend over the toe of the toothbrush. The other disclosed bristle tufts are arranged substantially in three columns along the balance of the brush head, each column containing about 10 rows of alternating length tufts. The two peripheral columns, along each side of the head, contain 0.350 inch (8.890 mm) long, round cross-section tufts, which are 0.0027 sq. inches (0.0174 $cm^2$) in cross-sectional area; alternating with 0.440 inch (11.176 mm) long rectangular tufts, 0.0045 sq. inches (0.029 $cm^2$) in cross-sectional area. The center column contains 0.440 inch (11.176 mm) long, 0.0045 sq. inch (0.029 $cm^2$) rectangular tufts alternating with shorter, 0.350 inch (8.890 mm) long, 0.0084 sq. inch (0.0542 $cm^2$) rectangular tufts. As disclosed in U.S. Pat. No. 5,511,275, a bristle tuft's stiffness is directly proportional to the number of bristles in that tuft and to the density of the packing, i.e. a buttressing factor. The large, 0.0373 (0.241 $cm^2$) and 0.0084 square inch (0.0542 $cm^2$), densely packed, uniform flat trimmed bristle tufts disclosed in WO 99/23910 will exhibit significant buttressing and stiffness as described in U.S. Pat. No. 5,511,275, reducing the brushes ability to conform to the curved surfaces of the teeth without deleterious, excessive forceful application of the toothbrush by the user.

There is a need in the art for a toothbrush having a diversity of tufts, including curved bristle trim and wherein the bristle tufts better conform to the curvature of the teeth to provide enhanced cleaning without the need for deleterious, excessive brushing force by the user.

SUMMARY OF INVENTION

The present invention comprises a toothbrush with an elongated head connected to an elongated handle, which head has a first and a second grouping of flexible bristle tufts extending therefrom, both groupings have trim patterns containing at least one radius of curvature to provide enhanced conformity to the curvature of the teeth; the first grouping, located nearer the toe of the brush head, contains bristle tufts angled slightly towards the toe of the toothbrush, and wherein the bristle tufts are relatively more densely packed, providing a combination of features which provides the flexibility and configuration of bristle tufts to conform to the curvature of the tooth to provide enhanced cleaning thereof. The second grouping contains a first subset of bristle tufts about the periphery of the second grouping acutely angled toward the toe of the toothbrush and a second subset bristle tufts acutely angled toward the handle of the toothbrush, which two subsets of bristle tufts are relatively less densely packed, for a combination of features which provides enhanced penetration of the interproximal spaces between the teeth during back and forth brushing of the facial and lingual tooth surfaces, a brushing method used by a significant percentage of users.

A second embodiment of the present invention comprises the two groupings of bristle tufts of the first embodiment, wherein in the second grouping the rows of bristle tufts are alternatingly longer and shorter, allowing each longer row to more deeply penetrate the interproximal spaces to reach and clean the tooth surfaces therein, without the interference of the adjacent rows abutting against the facial or lingual surfaces of the teeth, thereby enhancing the ability of the toothbrush to better conform to the curvature of the teeth for enhanced cleaning thereof.

BRIEF DESCRIPTION OF DRAWINGS

While the specification concludes with the claims which particularly point out and distinctly claim the invention, it is believed the present invention will be better understood from the following description of several particularly preferred embodiments taken in conjunction with the accompanying drawings, in which like reference numerals identify similar elements and wherein:

DETAILED DESCRIPTION

Figure 1:
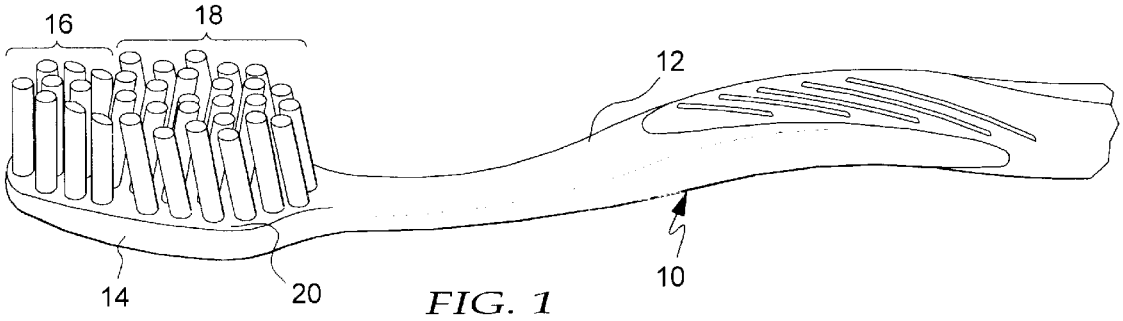
FIG. 1 is a perspective view, showing an embodiment of the toothbrush bristle pattern of the present invention.

Referring now to FIG. 1, a perspective view of a toothbrush 10, showing a portion of an elongated handle 12 and an elongated head 14 with two groupings of bristle tufts 16, 18 extending from the face 20 thereof, which two bristle tuft groupings 16, 18 embody the features and construction of this invention. The bristle tufts within each of the two groupings 16, 18 are designed to be flexible, so as to easily conform to the uneven topography of the teeth. Such flexible bristle tufts preferably have a round cross-section of from about 0.05 (1.27 mm) to about 0.01 inches (0.254 mm) in diameter, with corresponding cross-sectional areas of about 0.001 sq. inches (0.00645 $cm^2$) to about 0.006 sq. inches (0.03871 $cm^2$). The bristle tufts within each of the two groupings 16, 18 are generally arranged in rows which are substantively transverse to the longitudinal axis C—C of the head 14 and wherein a row may include only one bristle tuft. While not completely shown, the reader will understand that the handle 12 extends further.

The bristle trim of each grouping 16, 18 of bristle tufts within the present invention contains at least one radius of curvature, to better conform to the curved topography of the dentiture. It is preferred that the first grouping 16 have a bristle trim with a curved side profile, divided into a front portion and a rear portion having different radii of trim curvature. The front portion having a first radius of curvature R1 which is convex with respect to the brush face 20, arced toward the toe 22 of the brush head 14, see FIG. 2. This first radius of curvature R1 should be from about 4 to about 6 mm and involve only the bristle trim of the first 2 or 3 rows of bristles proximate to the toe 22 of the toothbrush 10. It is preferred that the rear portion have a second radius of curvature R2 be from about 10 to about 20 mm, arced away from the toe 22 of the toothbrush 10, convex with respect to the brush face 20, see FIG. 2. These radii, R1 and R2, enhance the ability of the first grouping 16 of bristle tufts to scrub and clean the curved interproximal areas, especially, as the user brushes the posterior teeth, when the user is often holding the toothbrush 10 at a slight angle to the facial tooth surfaces.

Figure 5:
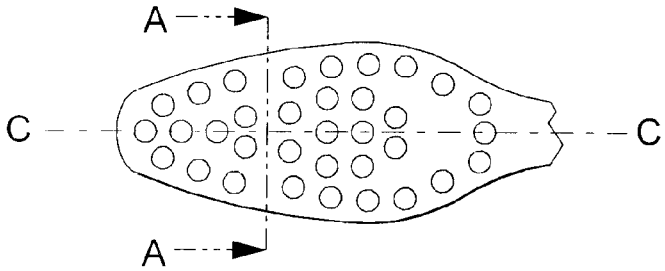
FIG. 5 is a top plan of the brush head of the embodiment of FIG. 1, each bristle tuft is shown as a circle.
Figure 5A:
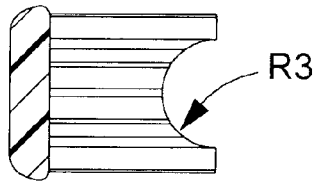
FIG. 5A is a cross-sectional elevation showing the bristle tufts across the cross-section A—A in FIG. 5, in the direction indicated.

As shown in FIG. 5A, a cross-section of the second grouping 18 as indicated in FIG. 5, the preferred bristle trim of the second grouping 18 contains a radius of curvature R3 in the form of a channel oriented longitudinally therethrough. This channel has a radius of curvature R3 of from about 0.0787 inches (2 mm) to about 0.2362 inches (6 mm) and most preferably about 0.1181 inches (3 mm). This channel enhances the ability of the second grouping 18 to conform to the curved segments of the tooth between the facial and occlusal, and lingual and occlusal surfaces; which conformation is especially important while brushing the posterior teeth.

Figure 2:
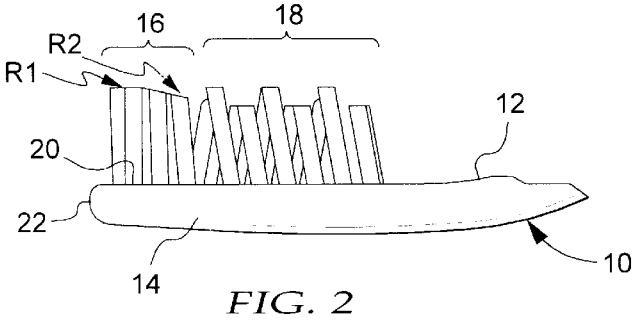
FIG. 2 is a side elevation of the embodiment of FIG. 1, the other side elevation being a mirror image of FIG. 2.

Referring to FIG. 2, a side elevation view of the present invention, it can be seen that the density of the bristle tufts within the first grouping 16 of bristle tufts, most proximate to the toe 22 of the head 14, is greater than the density of the bristle tufts in the second grouping 18 of bristle tufts, which is closest to the handle 12. The relatively greater tuft density within the first grouping 16, facilitates that groupings ability to scrub the relatively flat facial, lingual and occlusal tooth surfaces for enhanced cleaning. Within the first grouping 16, the spacing between the outer bristle tufts closest to the sides of the head 14 (hereinafter the peripheral tufts) is preferably from about 0.0787 inches (2 mm) to about 0.1181 inches (3 mm), a relatively denser spacing which still facilitates the desired flexibility discussed above. The other, interior, bristle tufts within the first bristle grouping 16, are preferably disposed along the longitudinal axis C—C and centered so as to be medially between the peripheral tufts.

In the present invention, the lesser bristle tuft density within the second grouping 18, is such that the longitudinal spacing, along the brush head 14, between the peripheral tufts is preferably from about 0.1378 inches (3.5 mm) to about 0.1575 inches (4.0 mm) center-to-center. Transversely, across the head 14, the center-to-center spacing between bristle tufts in the second grouping 18 is preferably at least about 0.0787 inches (2 mm). The interior bristle tufts within the second grouping 18 are also preferably located such that their centers are transversely aligned with each other, but transversely offset by at least about 0.00787 inches (0.2 mm) from the centers of the peripheral tufts, which are themselves transversely aligned with each other. The lower tuft density within the second grouping, combined with the natural flexibility of the bristle tufts and the slight staggering of the bristle tufts across the brush head 14, facilitates the penetration of the bristle tufts into the interproximal areas. Further, this combination of features within the second grouping 18 enhances the freedom of the tufts to flex without mutual interference, such that they exhibit greater movement and splay, to flick and otherwise dislodge food particles trapped in the interproximal areas.

Figure 3:
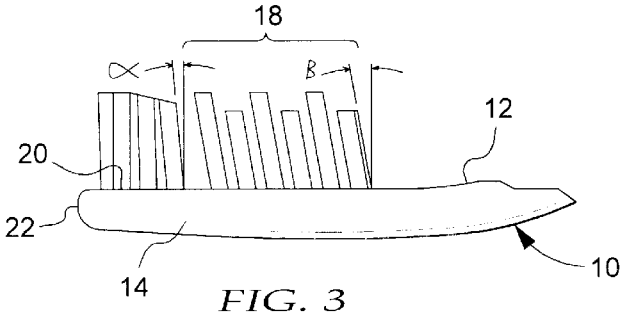
FIG. 3 is a side elevation of the embodiment of FIG. 1, showing a first partial bristle pattern, containing only the bristle tufts as indicated in FIG. 3A, a top plan of the brush head, wherein each present bristle tuft is shown as a circle, the location of each missing bristle tuft is indicated by a cross (+)
Figure 3A:
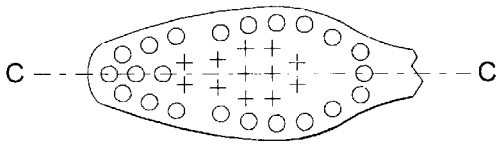
Figure 4:
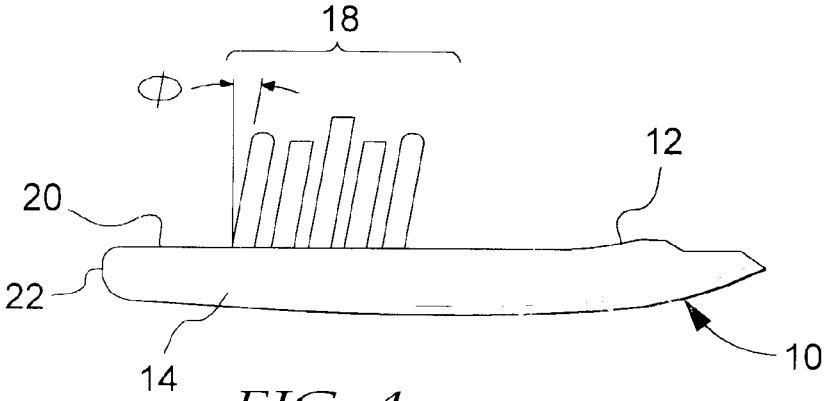
FIG. 4 is a side elevation of the embodiment of FIG. 1, showing a second partial bristle pattern, containing only the bristle tufts indicated in FIG. 4A, a top plan of the brush head, with the same notation as FIG. 3A.
Figure 4A:
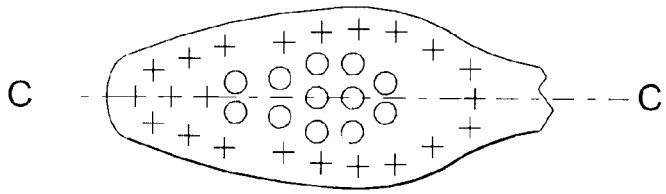

Referring to FIGS. 3 and 4, side elevations of the embodiment of FIG. 1, showing partial bristle patterns containing only the bristle tufts, respectively, indicated in FIGS. 3A and 4A, top plan views of the brush head; wherein, each present bristle tuft is shown as a circle and each missing/non-shown bristle tuft is indicated by a cross (+). As shown in FIG. 3, the bristle tufts within the first grouping are preferably angled, at an angle $\alpha$, toward the toe 22 of the toothbrush 10. The angle ax is from about 3 to about 7 degrees from the perpendicular in relation to the brush face 20, most preferably about 5 degrees from the perpendicular. This angle allows the bristle tufts of the first grouping 16 to be lodged more perpendicularly to the facial tooth surfaces as the brush is moved into and out-of the oral cavity during brushing, when the user is often holding the toothbrush 10 at a slightly acute angle to the facial tooth surfaces.

Continuing to refer to FIGS. 3 and 4, and observing the second grouping 18, wherein the peripheral bristle tufts are acutely angled, at an angle β, toward the toe 22 of the toothbrush 10 and the interior bristle tufts are acutely angled, at an angle ϕ, toward the handle 12 of the toothbrush 10. These bristle tufts are preferably angled, in their respective directions, at an angle β or ϕ, of from about 8 to about 15 degrees from the perpendicular in relation to the brush face 20. These angles allow the bristle tufts to better penetrate the interproximal areas as the toothbrush is moved into and out-of the oral cavity during brushing.

An alternative embodiment of the present invention is such that the rows of angled bristle tufts in the second grouping are alternatingly longer and shorter, i.e. higher and lower with respect to the face 20 of the toothbrush 10. It is preferred that the longer rows of angled bristle tufts be at least 0.0394 inches (1 mm) and more preferably about 0.0591 inches (1.5 mm) to about 0.0787 inches (2 mm) greater in length than the shorter rows of angled bristle tufts; such that, for example, the bristle tufts within the shorter rows may be 0.3937 inches (1 cm) in length and the bristle tufts within the longer rows may be 0.4724 inches (1.2) cm in length. This alternating pattern of bristle lengths within the second grouping allows the longer rows to more deeply penetrate the interproximal spaces for cleaning therein, while the adjacent shorter rows do not abut against the various tooth surfaces to restrict such penetration.

Any conventional flexible bristle material may be utilized in the present invention. Nylon and polyester are preferred bristle materials, with nylon being the most preferred. A preferred brand of nylon, 6, 12 nylon, is available from E.I. DuPont de Nemours and Company of Wilmington, Del. under the tradename of TYNEX®.

In addition to being flexible, it is preferred that he bristles within the present invention be soft enough to clean the gingival margin and remove debris and plaque without causing irritation and bleeding. It is preferred that the bristles be end-rounded and have a diameter be between about 0.003 inches (0.0762 mm) and about 0.012 (0.3048 mm) inches, most preferred between 0.005 inches (0.127 mm) and 0.008 inches (0.2032 mm).

The bristles may be implanted in the toothbrush face 20 in tufts using either typical staple technology or using more modern non-staple technology as disclosed in U.S. Pat. Nos. 4,635,313, 4,637,660, 4,954,305, 5,045,267, 5,390,984, 5,533,791, 5,609,890, and 5,823,633. Such non-staple technology involves processes wherein the bristle tufts are fused into the brush head 14, by heating both the bristle tufts and the brush head 14, which are then brought together; or, wherein the ends of the bristle tufts are pre-positioned in an injection mold prior to the introduction of the toothbrush material, which toothbrush material is subsequently injected about the ends of the bristle tufts, locking the bristle tufts in place in the toothbrush head 14.

What is claimed is:

1. An enhanced cleaning toothbrush comprising:

(a) an elongated handle (12);

(b) an elongated head (14) connected to and extending from the handle (12), the head (14) ending in a toe (22) distal from the handle (12);

(c) the elongated head (14) having a face (20) on one side thereof and a longitudinal axis therethrough;

(d) a plurality of flexible bristle tufts extending from the face (20);

(e) the bristle tufts being grouped into a more densely packed first grouping (16) of bristle tufts located proximate to the toe (22) and a less densely packed second grouping (18) adjacent to the first grouping (16) and extending across the balance of the face (20) to the handle (12);

(f) each of the first and second bristle tuft groupings (16, 18) have a trim pattern with at least one radius of curvature therein;

(g) the bristle tufts within the first grouping (16) being acutely angled (α) with respect to the face (20) toward the toe (22); and (h) the second bristle grouping (18) having a first and second subset of bristle tufts therein, the first subset including the peripheral bristle tufts adjacent to each side of the elongated head (14) and the row of bristle tufts most proximate to the handle (12), which first subset of bristle tufts are acutely angled (β) with respect to the face (20) toward the toe (22), the second subset of bristle tufts including the balance of bristle tufts in the second grouping (18), are acutely angled (ϕ) with respect to the face (20) toward the handle (12).

2. The toothbrush of claim 1, wherein the cross-section of the bristle tufts is round.

3. The toothbrush of claim 1, wherein the cross-sectional area of the flexible bristle tufts is from about 0.001 sq. inches (0.00645 $cm^2$) to about 0.006 sq. inches (0.0387 $cm^2$).

4. The toothbrush of claim 1, wherein the first grouping (16) is divided into two portions, a front portion adjacent the toe (20) of the brush head and a rear portion adjacent the handle (12), the front portion having a curved side trim profile with a first radius of curvature (R1) and the rear portion having a curved side trim profile with a second radius of curvature (R2).

5. The toothbrush of claim 4, wherein the first radius of curvature (R1) is from about 0.1575 inches (4 mm) to about 0.2362 inches (6 mm).

6. The toothbrush of claim 4, wherein the second radius of curvature (R2) is from about 0.3937 inches (10 mm) to about 0.7874 inches (20 mm).

7. The toothbrush of claim 1, wherein the second grouping (18) has a bristle trim containing a channel oriented with the longitudinal axis of the toothbrush (10), having a radius of curvature (R3).

8. The toothbrush of claim 7, wherein the radius of curvature (R3) of the channel is from about 0.0787 inches (2 mm) to about 0.2362 inches (6 mm).

9. The toothbrush of claim 1, wherein the peripheral bristle tufts of the more densely packed first grouping (16) are spaced from about 0.0787 inches (2 mm) to about 0.1181 inches (3 mm) longitudinally, center-to-center.

10. The toothbrush of claim 1, wherein the peripheral bristle tufts of the less densely packed second grouping (18) are spaced from about 0.1378 inches (3.5 mm) to about 0.1575 inches (4.0 mm) longitudinally, center-to-center.

11. The toothbrush of claim 1, wherein the bristle tufts within the first grouping (16) are angled (α) at an angle of from about 3 to about 7 degrees from the perpendicular toward the toe (22) of the toothbrush (10).

12. The toothbrush of claim 1, wherein the peripheral bristle tufts are angled toward the toe (22) of the toothbrush (10), at an angle (β) of from about 8 to about 15 degrees from the perpendicular.

13. The toothbrush of claim 1, wherein the interior bristle tufts are angled toward the handle (12) of the toothbrush (10), at an angle (ϕ) of from about 8 to about 15 degrees from the perpendicular.

14. An enhanced cleaning toothbrush comprising:

(a) an elongated handle (12);

(b) an elongated head (14) connected to and extending from the handle (12), the head (14) ending in a toe (22) distal from the handle (12), (c) the elongated head (14) having a face (20) on one side thereof and a longitudinal axis therethrough;

(d) a plurality of flexible bristle tufts extending from the face (20);

(e) the bristle tufts being grouped into a more densely packed first grouping (16) of bristle tufts located proximate to the toe (22) and a less densely packed second grouping (18) adjacent to the first grouping (16) and extending across the balance of the face (20) to the handle (12);

(f) each of the first and second bristle tuft groupings (16, 18) have a trim pattern with at least one radius of curvature therein;

(g) the bristle tufts within the first grouping (16) being acutely angled ($\alpha$) with respect to the face (20) toward the toe (22);

(h) the second bristle grouping (18) having a first and second subset of bristle tufts therein, the first subset including the peripheral bristle tufts adjacent to each side of the elongated head (14) and the row of bristle tufts most proximate to the handle (12), which first subset of bristle tufts are acutely angled ($\beta$) with respect to the face (20) toward the toe (22), the second subset of bristle tufts including the balance of bristle tufts in the second grouping (18), are acutely angled ($\phi$) with respect to the face (20) toward the handle (12); and (i) the rows of bristle tufts in the second grouping are alternatingly higher and lower.

15. The toothbrush of claim 14, wherein the cross-section of the bristle tufts is round.

16. The toothbrush of claim 14, wherein the cross-sectional area of the flexible bristle tufts is from about 0.001 sq. inches (0.00645 $cm^2$) to about 0.006 sq. inches (0.0387 $cm^2$).

17. The toothbrush of claim 14, wherein the first grouping (16) is divided into two portions, a front portion adjacent the toe (20) of the brush head and a rear portion adjacent the handle (12), the front portion having a curved side trim profile with a first radius of curvature (R1) and the rear portion having a curved side trim profile with a second radius of curvature (R2).

18. The toothbrush of claim 17, wherein the first radius of curvature (R1) is from about 0.1575 inches (4 mm) to about 0.2362 inches (6 mm).

19. The toothbrush of claim 17, wherein the second radius of curvature (R2) is from about 10 to about 20 mm.

20. The toothbrush of claim 14, wherein the second grouping (18) has a bristle trim containing a channel oriented with the longitudinal axis of the toothbrush (10), having a radius of curvature (R3).

21. The toothbrush of claim 20, wherein the radius of curvature (R3) of the channel is from about 0.0787 inches (2 mm) to about 0.2362 inches (6 mm).

22. The toothbrush of claim 14, wherein the peripheral bristle tufts of the more densely packed first grouping (16) are spaced from about 0.0787 inches (2 mm) to about 0.1181 inches (3 mm) longitudinally, center-to-center.

23. The toothbrush of claim 14, wherein the peripheral bristle tufts of the less densely packed second grouping (18) are spaced from about 0.1378 inches (3.5 mm) to about 0.1575 inches (4.0 mm) longitudinally, center-to-center.

24. The toothbrush of claim 14, wherein the bristle tufts within the first grouping (16) are angled at an angle ($\alpha$) of from about 3 to about 7 degrees from the perpendicular toward the toe (22) of the toothbrush (10).

25. The toothbrush of claim 14, wherein the peripheral bristle tufts are angled toward the toe (22) of the toothbrush (10), at an angle ($\beta$) of from about 8 to about 15 degrees.

26. The toothbrush of claim 14, wherein the interior bristle tufts are angled toward the handle (12) of the toothbrush (10), at an angle ($\phi$) of from about 8 to about 15 degrees.

27. The toothbrush of claim 14, wherein the bristle tufts in the shorter rows within the second grouping are 0.3937 inches (1 cm) in length and the bristle tufts within the longer rows within the second grouping are 0.4724 inches (1.2) cm in length.

* * * * *